350-332 SR
6/2/81 XR 4,271,410

United States Patent [19]

Crawford

[11] 4,271,410

[45] Jun. 2, 1981

[54] LCD DATA PROCESSOR DRIVER AND METHOD

[75] Inventor: Donald G. Crawford, Anaheim, Calif.

[73] Assignee: Rockwell International Corporation, El Segundo, Calif.

[21] Appl. No.: 932,590

[22] Filed: Aug. 10, 1978

[51] Int. Cl.[3] ..... G08B 5/36

[52] U.S. Cl. ..... 340/765; 340/802; 340/811; 350/332

[58] Field of Search ..... 340/765, 784, 798, 802, 340/805; 350/356; 323/16, 19, 23, 25, 40

[56] References Cited

U.S. PATENT DOCUMENTS

| | | | |
|---|---|---|---|
| 3,694,662 | 9/1972 | Grygera et al. | 323/25 |
| 3,896,430 | 7/1975 | Hatsukano | 340/765 |
| 3,898,646 | 8/1975 | Washizuka et al. | 340/765 |
| 3,911,426 | 10/1975 | Mouton et al. | 340/765 |
| 3,976,994 | 8/1976 | Washizuka et al. | 340/765 |
| 4,038,564 | 7/1977 | Hakata | 340/803 |
| 4,060,801 | 11/1977 | Stein et al. | 340/805 |
| 4,062,626 | 12/1977 | Kawakami et al. | 340/784 |
| 4,121,203 | 10/1978 | Edwards et al. | 340/765 |

*Primary Examiner*—David L. Trafton
*Attorney, Agent, or Firm*—H. Fredrick Hamann; Wilfred G. Caldwell

[57] ABSTRACT

The invention is a method and apparatus for multiplexing liquid crystal displays of increased numbers of alphanumeric characters without shadowing or flicker and minimizes contrast degradation. Bipolar segment voltages are interrelated to bipolar tri-level backplane voltages for logical selection of voltage differences across the segments to provide either energization or less than threshold voltage application. The polarities of the bipolar voltages are automatically reversed at the end of each cycle of sequential application of backplane voltages to all backplanes to avoid metallization plating problems in the display. Power level shift is accomplished in the logic stage for the display, and CMOS active gate elements are used in lieu of power consuming resistive networks for a total power requirement of less than 5 milliwatts to multiplex and drive up to 7 characters of 16 segments each. Simplified interfacing with a microprocessor is provided using standard 8 bit bus and control signals. A FIFO is loaded by the processor and the segment data signals are applied to the LCD at a relatively slow rate which releases the processor for other duties most of the time. An op amp voltage supply produces the bipolar segment voltages equally and oppositely spaced from a reference backplane voltage. It also provides for adjustment of the segment voltages while maintaining the equal and opposite relation to accommodate different threshold values of multiplexing fluids.

7 Claims, 8 Drawing Figures

LCD DATA PROCESSOR DRIVER AND METHOD

The present invention relates to LCD multiplex processing and driver circuits and methods therefor and, more particularly, to the provision for multiplex driving of a large number of alphanumeric LCD characters without shadowing or flicker effects.

PRIOR ART

The prior art for display, based on liquid crystal display segmental characters is limited to the multiplexing of four characters capable only of numeric display without undue flicker and contrast degradation. Inherent in these limitations are the requirement for sine wave generators for generating AC voltages to actuate the liquid crystal segments, the use of split backplanes, and the limitive use of two voltage levels only for driving the backplanes and the segments. The existing circuitry is characterized by high power consumption.

The readability of the display is considerably handicapped by shadowing effects when additional characters are multiplexed. And, in general, the systems simply are not digitally oriented or readily interfaced with microprocessors.

CURRENT INFORMATION in ELECTRONICS for May 25, 1978, at page 113, an article appears entitled "Multiplexing-Liquid Crystal Displays" which presents a rather thorough discussion of multiplexing crystal fluids with inherent threshold voltage parameters, followed by a discussion of contrasts and contrast ratio.

THE INVENTION

The invention is a method and apparatus for multiplexing liquid crystal displays of increased numbers of characters without shadowing or flicker and minimizes contrast degradation. Bipolar segment voltages are interrelated to bipolar backplane voltages for logical selection of voltage differences across the segments to provide either energization or less than threshold voltage application. The polarities of the bipolar voltages are automatically reversed at the end of each cycle of application of backplane voltages to all backplanes to avoid plating problems. A total power requirement of less than 5 milliwatts to drive 6 or 7 characters of 16 segments each has been demonstrated but the system is designed to handle n characters.

DESCRIPTION OF A PREFERRED EMBODIMENT

In General

Figure 1:
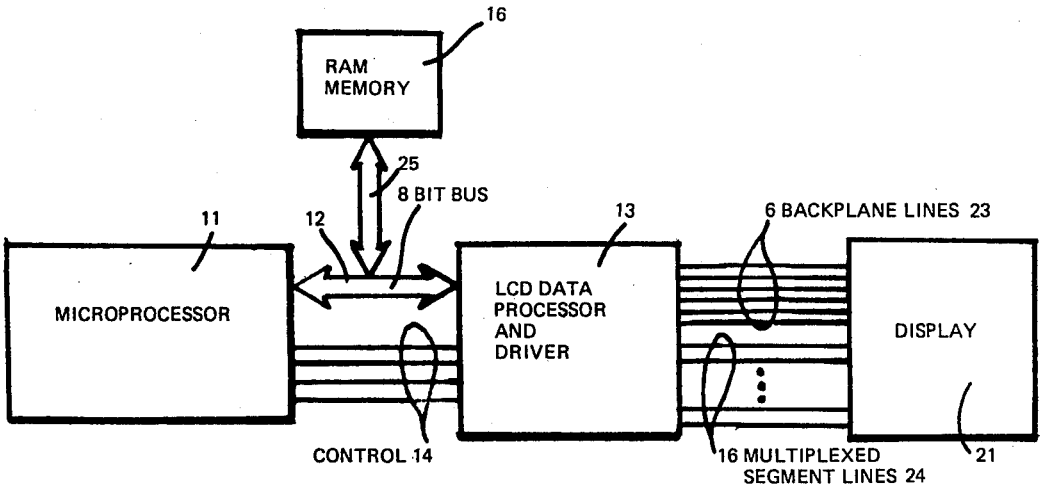
FIG. 1 is a general block diagram showing the invention in relation to a microprocessor and display.

The DISPLAY 21 (FIG. 1), by way of example, consists of one backplane 41 (FIG. 2) for each 16-segment alphanumeric character (1*a*). Each character has 16 individual segments (a, b, c etc.) with like segments of each character being tied to like segments of all other characters. Thus, segment a of the first character is connected to segment a of the next character and so forth. Therefore, the connection to the display 21 consists of 16 segment lines plus one line for each backplane (see FIG. 2).

By using low power logic CMOS and level shifting such that the least amount of logic is operated at the higher voltage level, the objective of minimal power consumption is obtained. The unit requires less than 5 milliwatts and may even operate on as little as 3 milliwatts.

The provision of standard bus orientation simplifies the interface which is compatible with microprocessors. It consists of an 8 BIT BUS 12 (FIG. 1), a chip select, a strobe, a reset line, and a data-in-ready not line (see control 14). The MICROPROCESSOR 11 loads data into the DISPLAY DRIVER 13 by placing data on the BUS 12 and raising the chip select and the strobe line for each byte of data to be loaded. Data may continue to be loaded until the $\overline{\text{DIR}}$ line 77 (FIG. 2) is raised to indicate the input STORAGE REGISTER 15 (FIFO) is filled. The MICROPROCESSOR 11 can now ignore the DISPLAY until the data is all blocked out to the DISPLAY which takes place at a very slow rate relative to the capabilities of the MICROPROCESSOR. The $\overline{\text{DIR}}$ line will be reset to a low level as soon as the first byte of data is transferred from the FIFO 15 to the DISPLAY 21.

With the application of a continuous CLOCK 51, (FIG. 2), the data in the FIFO 15 is strobed out in groups of two bytes per character. One backplane is enabled at a time, the two bytes of data are passed through LEVEL SHIFTERS (see 61, 43 in FIG. 2) and latched into the appropriate SEGMENT DRIVERS. The first byte is latched into the segment drivers for lines $S_a$ through $S_h$ (U15, U16 in FIG. *7b*) and the second byte into segment drivers (U17, U18) for lines $S_j$ through $S_s$.

The backplanes continue to be enabled one at a time, sequencing from one (1*a*, FIG. 2) through the last one (1*n*). Once the last one is enabled, the BACKPLANE SELECT (U11, FIG. *7b*) automatically resets itself to backplane one and continues recycling one through the last until the FIFO 15 is empty or the reset line is raised. Each time the backplane SELECT (U11) automatically resets, the output logic levels of the segments and backplanes are inverted. Therefore, for one cycle (backplane one through the last) the backplane and segments will be positive logic out and for the next cycle they will be negative logic out. The inverting of the logic levels provides an AC type signal herein referred to as bipolar for operating the DISPLAY.

In Detail

In FIG. 1, the MICROPROCESSOR 11 is shown connected over bus 12 to the LCD DATA PROCESSOR AND DRIVER 13. Also, the control lines are shown at control 14. The RAM MEMORY 16 is normally associated with MICROPROCESSOR 11.

The DISPLAY itself is indicated at 21, and is supplied from the DRIVER 13 with six BACKPLANE LINES 23 and 16 SEGMENT LINES 24.

Figure 2:
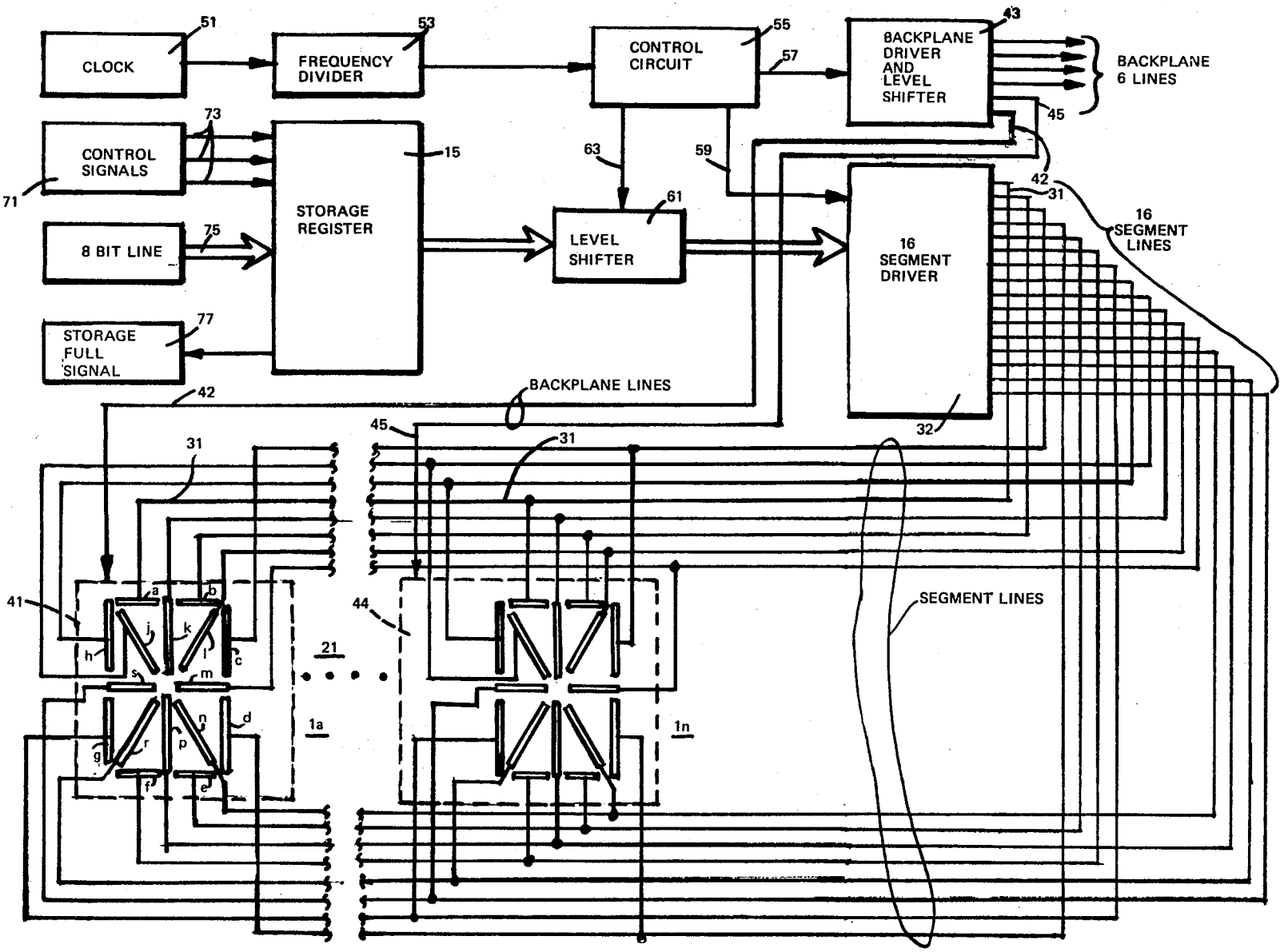
FIG. 2 is a more detailed block diagram of the invention with alphanumeric characters.

The BUS line 25 between BUS 12 and RAM MEMORY 16 permits two way data or instruction transfer between the MICROPROCESSOR and the RAM MEMORY. In FIG. 2, the STORAGE REGISTER 15 is the temporary storage resistor (FIFO) and the DISPLAY is shown at 21 comprising character 1*a* and character 1*n*. Corresponding segments are connected together, as for example segment "a" of character 1*a* is connected over lead 31 to segment "a" of character 1*n* and this supply line leads to the 16 SEGMENT DRIVER 32, the other segments are correspondingly treated in like multiplexing manner.

Backplane 41 for character 1*a* is connected over lead 42 to BACKPLANE DRIVER AND LEVEL SHIFTER 43. Backplane 44 is connected over lead 45 to the BACKPLANE DRIVER AND LEVEL SHIFTER 43 and there are four remaining lines shown for four additional characters. While the circuit has been tested in the operation of six and seven characters with complete elimination of shadowing effect, nevertheless the circuitry is capable of being extended to handle additional numbers of characters, as LCD technology improves.

In FIG. 2, a continuously running CLOCK 51 is supplied to FREQUENCY DIVIDER 53 which may divide its normal frequency by 128 to obtain a clock frequency compatible with the LCD DISPLAY. The clock frequency is supplied to CONTROL CIRCUIT 55 which consists of logic in turn used to control BACKPLANE DRIVER AND LEVEL SHIFTER 43 over lead 57 and the 16 SEGMENT DRIVER over the lead 59.

Also the CONTROL CIRCUIT is effective at LEVEL SHIFTER 61 over lead 63. The control circuit 55 includes a polarity reversing device which is effective over leads 57 and 63 to reverse the polarity of the backplane and segment voltages each cycle of backplane voltages.

The interface with the microprocessor includes CONTROL SIGNALS 71 effective over leads 73 to STORAGE REGISTER 15 on the 8 BIT LINE with BUS 75 for the segment data and the STORAGE FULL SIGNAL 77 for communication from the STORAGE REGISTER to the MICROPROCESSOR 11 (FIG. 1).

Figure 3:
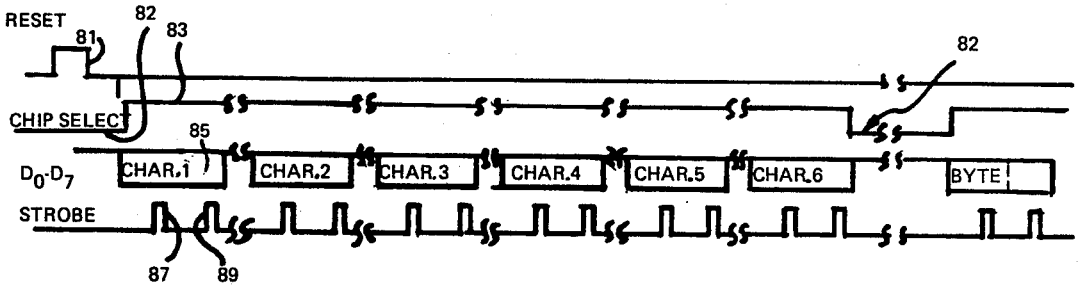
FIG. 3 is a timing chart showing typical waveforms for loading data into the storage register or FIFO.

In FIG. 3, there is shown a RESET pulse 81 with the CHIP SELECT changing from low level 82 to high level 83 as a result of RESET pulse 81.

CHIP SELECT enables loading of MEMORY 15 with the character data signals $D_0$–$D_7$. The first character 85 has its initial byte strobed into the memory by strobe pulse 87. The second byte is strobbed into the memory by pulse 89. The rest of the characters are divided, also into two eight-bit bytes, so that 16 bits supply the 16 segments per character. When the CHIP SELECT returns to level 82, the loading is terminated. During this period the MICROPROCESSOR can perform other functions.

When RESET is activated, it clears the FIFO and initializes the DRIVER and if the CLOCK is running and data is in the register, two bytes go on through to form character 1.

Figure 4:
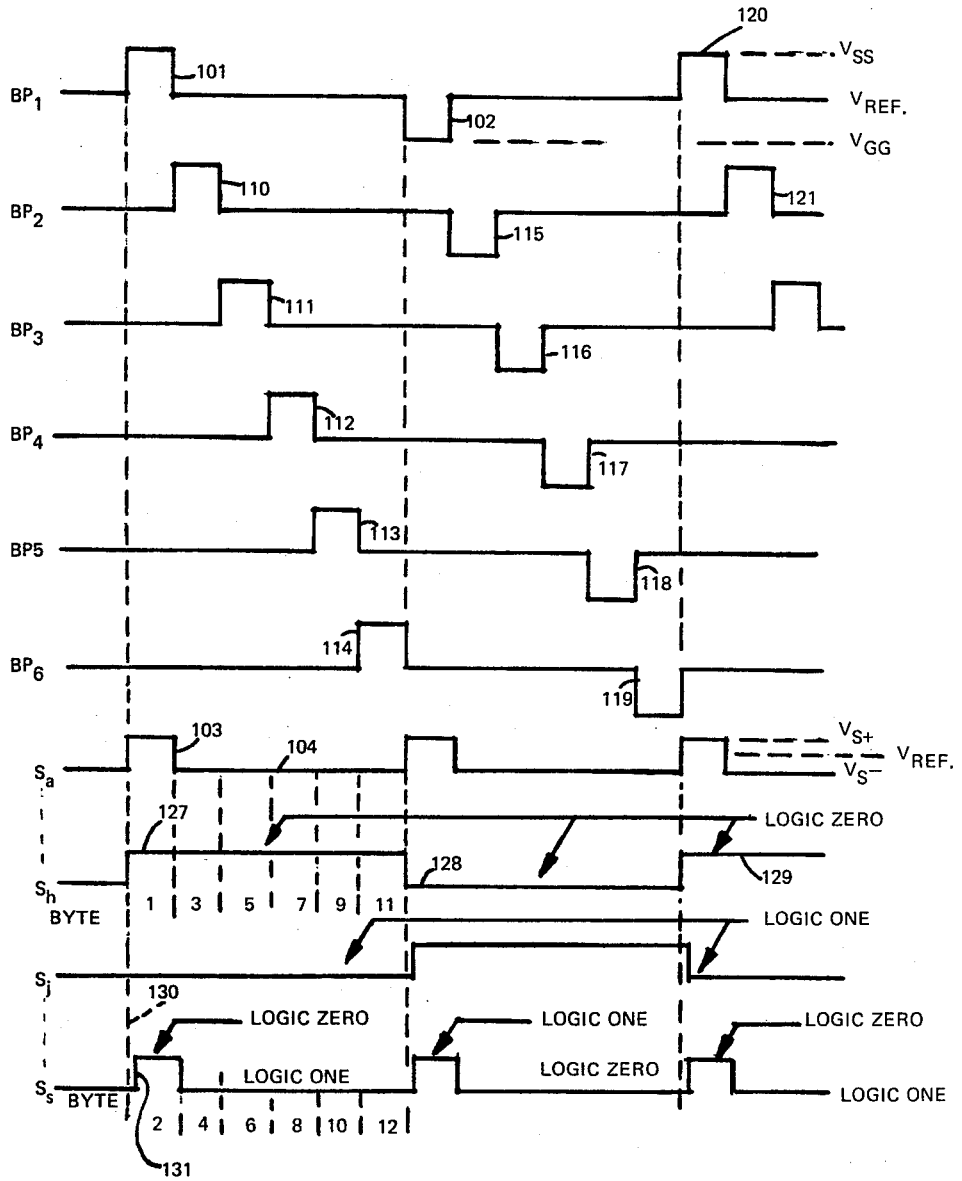
FIG. 4 is a timing chart showing relationships between backplane voltages and segment voltages.

In FIG. 4, the bipolar backplane voltages are shown for application to 6 character backplanes relative to segment voltages $S_a$, $S_h$, $S_j$ and $S_s$. $BP_1$ pulse 101 is a positive going pulse, extending between the $V_{REF.}$ and the $V_{SS}$ level. The second backplane voltage 102 for character 1 is in the opposite direction but extending the same magnitude to the $V_{GG}$ level. It is this reversal of polarity each cycle along with reversal of the segment logic voltages, which avoids the plating problems in the display.

Looking at the voltage on segment $S_a$, it will be seen that the pulse 103 is positive going, in the same direction as backplane pulse 101, and therefore the difference voltage is insufficient to energize the liquid crystal material adjacent segment $S_a$. Pulse 103 rises to the $V_{S+}$ level which is between $V_{SS}$ and $V_{REF.}$. The voltage on segment $S_a$ is shown reversed at 104 to the $V_{S-}$ level and segment $S_a$ is energized for the remaining five backplane pulses 110 through 114. During the second cycle of backplane voltages, the segment $S_a$ is on for backplane voltage 102, but it is off for the backplane voltages 115 through 119. It is off for the beginning pulse 120 of the third cycle, but on for the third cycle backplane pulse 121 where the segment $S_a$ is again equal to $V_{2-}$ level.

For segment $S_h$, the voltages 127, 128 and 129 are all logic zero (because of periodic polarity change) and the segment $S_h$ is not turned on for any backplane voltage. Segment $S_j$ shows the opposite condition with logic one configuration being always on, and segment $S_s$ shows a pattern of logic zeros and logic ones. Beneath the designation $S_a$–$S_h$ there is represented bytes 1, 3, 5, 7, 9 and 11. The same is true for bytes 2, 4, 6, 8, 10 and 12 under $S_j$–$S_s$. It is for this reason that the pulse 131 is shown slightly to the right of the vertical dotted line 130 to indicate that it is the second byte of the first character loaded.

Figure 5:
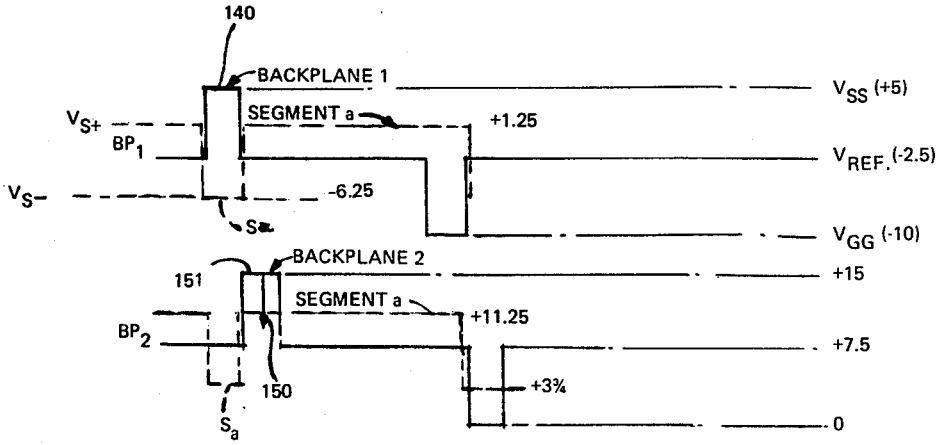
FIG. 5 is a further timing chart showing segment voltages superimposed on backplane voltages.

In FIG. 5, two of the backplane voltages ($BP_1$ and $BP_2$) and one ($S_a$) of the segment voltages are illustrated in superimposition to best indicate that it is the difference voltage which is effective across the segments. For example, the segment $S_a$ voltage is oriented oppositely from the $BP_1$ voltage 140. Segment a is therefore energized.

The five voltage levels appear clearly in this drawing as $V_{SS}$, $V_{REF.}$ and $V_{GG}$, all backplane voltages with $V_{S+}$ and $V_{S-}$ being the segment voltages. The segment $S_a$ is at the $V_{S+}$ level and falls to $V_{S-}$ level as backplane pulse 140 rises, thereby providing the maximum difference voltage across that segment.

By way of example, the potential levels are shown as $V_{SS}$ (plus 5 volts), $V_{REF.}$ (minus 2.5 volts), $V_{GG}$ (minus 10 volts), $V_{S+}$ (plus 1.25 volts), and $V_{S-}$ (minus 6.25 volts). For $BP_2$, the voltages are in the range from zero to +15 volts in lieu of from −10 to +5, merely to show the versatility of the system, and that it is the 15 volt differential which is important. Thus, segment $S_b$ is not energized because the voltage difference level is not sufficient.

The arrow 150 is provided in $BP_2$ pulse 151 to illustrate approximate threshold voltages. The threshold is at the level of the pointed arrow tip. It is the required difference voltage between the backplane and segment voltages for excitation. Since arrow 150 extends beyond the difference voltage, there are no shadow effects in this system of multiplexing.

The particular DISPLAY 21 used herein is a currently available multiplexing fluid display obtained from Hamlin, Incorporated, Lake and Grove Streets, Lake Mills, WS 53551.

Figure 6:
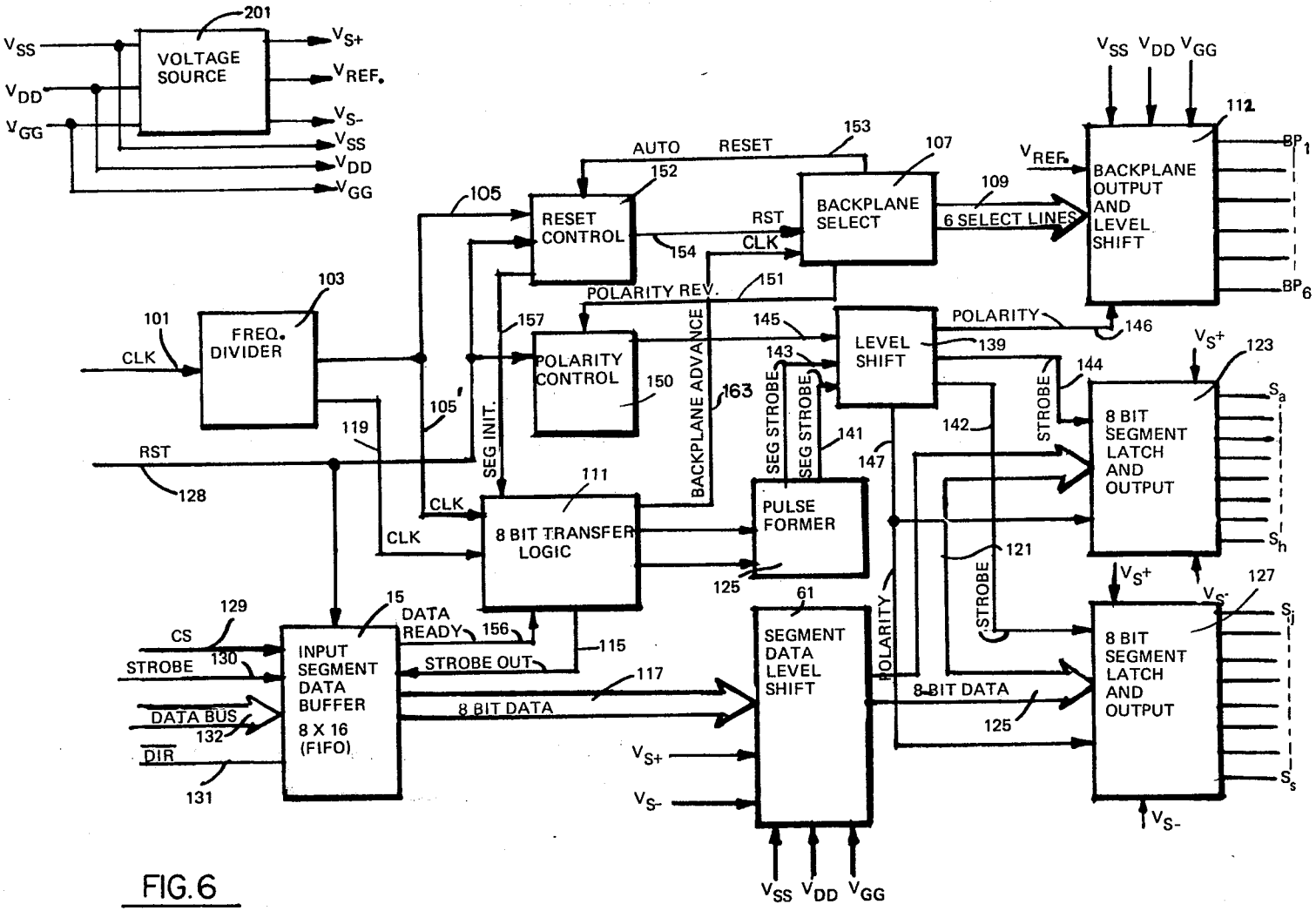
FIG. 6 is an even more detailed block diagram in the nature of a functional flow chart showing the invention for developing backplane and segment driver outputs; and FIGS. *7a* and *7b* together comprise one possible detailed schematic arrangement of a circuit of the invention.

In the block diagram of FIG. 6, the clock line 101 leads to FREQUENCY DIVIDER 103. Since the backplanes move at a much slower rate than the MICROPROCESSOR 11, it is necessary that the clock frequency be divided to provide a low frequency display clock. By way of example, the FREQUENCY DIVIDER 103 may divide by 128, and the low speed clock-frequency might be 80 hertz. This is used to refresh each backplane, and it is sufficiently above flicker frequency of approximately 30 hertz to be reliable.

The low speed clock line 105 from FREQUENCY DIVIDER 103 extends to BACKPLANE SELECT 107, increments it and it moves down one count at a time until it gets to six and then it starts over. Therefore, it is essentially a counter which merely sequences application of the backplane voltage pulses to the backplanes $BP_1$–$BP_6$. This path is over the 6 SELECT LINE bus 109 and via BACKPLANE OUTPUT AND LEVEL SHIFT 112 to appear on the $BP_1$–$BP_6$ lines.

The clock lead 105' extends downwardly to 8 BIT TRANSFER LOGIC 111. This presents the logic circuit to accept two new bytes of data when the backplane select is shifted by one backplane. In other words, it enables data transfer from the INPUT SEGMENT DATA BUFFER or register (FIFO) 15 via strobe output lead 115 for transfer over 8 BIT DATA lead 117 to SEGMENT DATA LEVEL SHIFT 61, which in turn provides one byte over bus 121 to the upper 8 BIT SEGMENT LATCH AND OUTPUT 123, and the second byte per word over 8 BIT DATA BUS 125 to lower 8 BIT SEGMENT LATCH AND OUTPUT 127. The outputs for these two driver sections for the segments extend respectively over leads $S_a$–$S_h$ and $S_j$–$S_s$ to each segment of each character so that multiplexing may be carried out by sequencing the backplane voltage levels and selecting the segments to be energized.

The clock lead 119 provides the high speed clock (e.g. 60 K hertz) for loading data into the 8 BIT SEGMENT AND LATCH 127 via 8 BIT TRANSFER LOGIC 111.

In FIG. 6, the operation of the circuit is initiated from the MICROPROCESSOR 11 of FIG. 1, which also supplies the reset to clear and for initialization of the chip at line 128, chip select on line 129, strobe on line 130, both of which are used together to strobe in eight bits of data until the DIR not ($\overline{DIR}$) goes high on line 131 when the FIFO 15 is full.

The clock (responsible for both the high speed and low speed waves) controls all internal timing and the output circuitry, and it is run independently of the processor. Thus, while the data is being utilized from FIFO 15, the processor has nothing to do with the control of the circuit of FIG. 6, and it may accomplish its other functions. Actually, the time devoted to updating or filling the FIFO is relatively small in the processor routine as the operation of the display segments is relatively slow. The FIFO 15 may be continuously refilled even while the FIFO data is being extracted provided that the $\overline{DIR}$ line is low. This occurs as soon as one byte is used from the 16 bytes stored in FIFO 15. Alternatively, the processor may wait until several bytes, i.e. up to 15 bytes are used before it refills the FIFO. It will be appreciated of course that storage capacity of the FIFO may be increased substantially, and the processor need then service it even less frequently. Thus the FIFO serves as a temporary storage register through which the data passes from the processor to the display segments.

The data from the FIFO 15 is transferred over 8 BIT DATA BUS 117 to SEGMENT DATA LEVEL SHIFT 61. The purpose of the LEVEL SHIFT 61 is to translate the output of voltage levels of the FIFO or the STORAGE REGISTER so as to be compatible with the requirements of the segment operating voltage levels. This power reduction does not show on the waveform charts. By way of example, the logic levels at the FIFO are +0 to +5 for the two levels. This is perhaps standard interface levels and $V_{DD}$ may equal 0 and $V_{SS}$ may equal +5. Obviously, these could be 10 or 15 volts as long as their relative potentials remain useful. In the change of logic level to logic level by LEVEL SHIFT 61, the voltage $V_{S+}$ is less than $V_{SS}$ and the voltage $V_{S-}$ is greater than $V_{GG}$. These display voltages are specified by the display manufacturer and it is necessary to shift the level to obtain the specified level for operating the display.

A second important consideration in respect to LEVEL SHIFT 61 is power consumption, wherein the driver is particularly concerned with utilization of the least power possible. Accordingly, the LEVEL SHIFT 61 does not comprise a conventional resistor network but all resistors possible have been eliminated from the circuitry and an active gate type level shifter, such as the 4053B, (FIG. 7*b*) has been employed with the CMOS logic. In this manner the SEGMENT DATA LEVEL SHIFT 61 serves in driving the SEGMENT LATCHES AND OUTPUT DRIVERS 123 and 127.

Another important feature involving the level shift is the fact that the circuitry of FIG. 6 employs level shifting after the FIFO, rather than prior thereto. This is to reduce the voltage and hence the power requirements because $V_{SS}$ to $V_{GG}$ may be a higher voltage than $V_{SS}$ to $V_{DD}$ or $V_{DD}$ and $V_{GG}$ may be equal.

The power level shift for the backplane voltages is handled in the same manner at BACKPLANE OUTPUT AND LEVEL SHIFT 112. In addition, three level shifters are included in LEVEL SHIFT 139 for handling the strobe pulses on leads 141, 142 and 143, 144, as well as the polarity pulses on leads 145, 146, and 145, 147.

Each time BACKPLANE SELECT 107 counts to six, it produces a signal which toggles POLARITY CONTROL 150 over lead 151 and also automatically supplies a signal to RESET CONTROL 152 over lead 153. RESET CONTROL 152 resets BACKPLANE SELECT 107 over lead 154 to start it counting to 6 again.

BACKPLANE SELECT 107 is notified of the presence of data over lead 163 from 8 BIT TRANSFER LOGIC 111 which receives a high speed clock enabling signal from FIFO 15 over DATA READY lead 156.

SEGMENT INITIALIZATION lead 157 applies a reset signal to 8 BIT TRANSFER LOGIC 111 from RESET CONTROL 152.

The pulse former 135 is only necessary if the output latches (FIG. 7*b*) are used in the example presented. Other latch drivers do not require pulse former 135.

The voltage source 201, shown in the upper left-hand corner of FIG. 6, supplies the above-mentioned voltages. $V_{SS}$ and $V_{GG}$ are obtained from a standard power supply and are used as inputs to the op amp voltage source 201 to produce $V_{S+}$ and $V_{S-}$ relative to $V_{REF}$. Voltage source 201 is the one which is adjustable and develops the segment voltages ($V_{S+}$ and $V_{S-}$) equally and oppositely spaced from the backplane voltage $V_{REF}$.

Figure 7A:
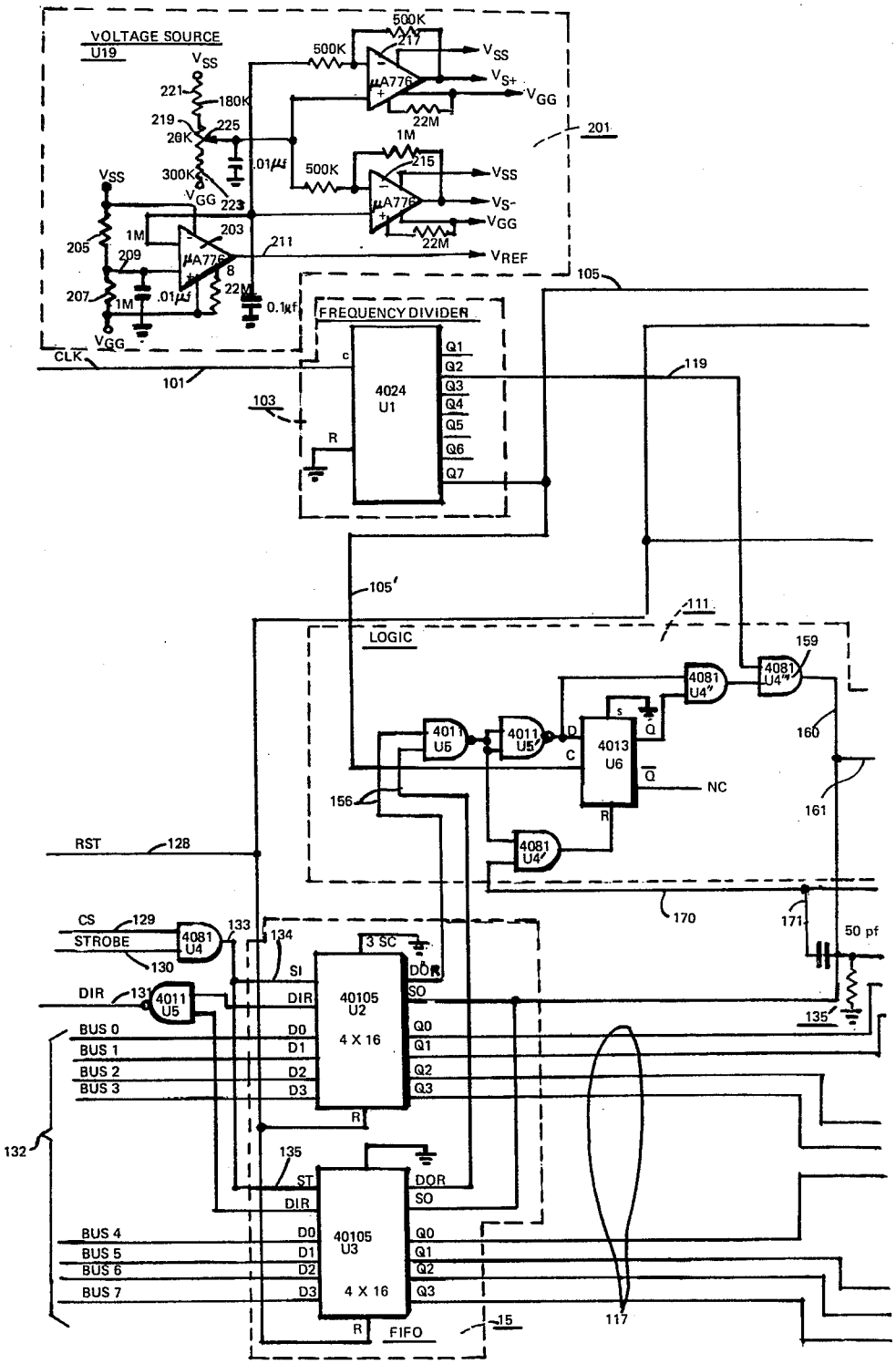
Figure 7B:
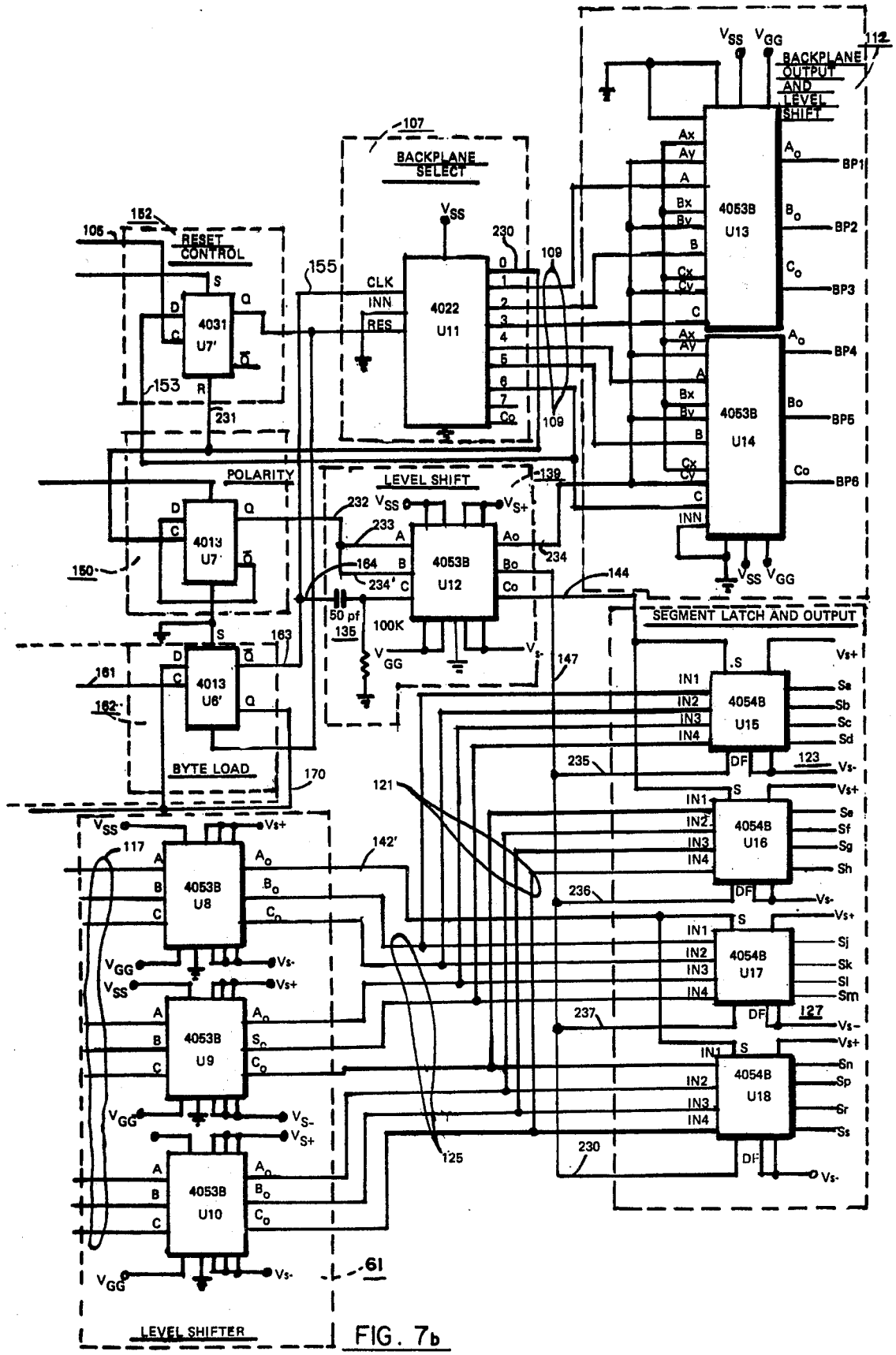

The detailed circuitry for voltage source 201 appears in FIG. 7*a* and this figure when taken together with FIG. 7*b* provides a detailed circuit layout for the functional block diagram of FIG. 6. Essentially, the same identifying numbers are used on the components of FIGS. 7*a* and 7*b* as were used in FIG. 6, but some further detail required additional numbers and where possible, the prime of the numbers used in FIG. 6 were applied in FIGS. 7*a* and 7*b*.

The circuit of FIGS. 7*a* and 7*b* is fabricatable any number of ways. The prototype of the present invention was built upon a circuit card from 19 ICs, identified as U1 through U19. By way of example, the chips employed in FIGS. 7*a* and 7*b* are of the RCA type with the exception of the op amps of the voltage source 201. The RCA numbers appear on these IC chips. The op amps were selected to be microprogrammable so that the current may be set for standby thereby further facilitating the extremely low power objectives.

Of course this circuit may be implemented as a monolithic chip or may be fabricated in hybrid form, but the principles of operation remain the same.

In the circuit of FIGS. 7*a* and 7*b*, the clock line 101 leads to FREQUENCY DIVIDER 103, shown as U1, which is an RCA IC type 4024 chip. The low speed clock line 105 from FREQUENCY DIVIDER 103 extends to RESET CONTROL 152, and the low speed clock line 105' extends to chip U6 of type 4013 of LOGIC 111. It will now be explained how the clocks and LOGIC 111 control the data processing.

The low speed clock from Q7 of FREQUENCY DIVIDER 103 simply periodically goes up and down at input C of the U6 chip of LOGIC 111. The two leads 156 extend respectively from the two 4×16 FIFO sections U2 and U3 to NAND gate U5, shown as chip 4011. The output from U5 supplies NAND gate U5', such that whenever both lines 156 are high, the output of U5' will be high, and this high is applied to 2 byte counter or Flip Flop U6 over input lead D and, also is applied as one input to AND gate U4", the Q lead from U6 being the other input to gate U4".

Thus, if the FIFO 15 has data ready for both sections (insuring that any slight delay of one or more bits will not give rise to a false signal from the FIFO), the output Q of U6 will be high whenever the slow clock on lead 105', appearing at lead C to U6, is high. AND gate U4", therefore goes high so that when the fast clock appears over lead 119 at AND gate 159 shown as U4'", a rising output will be applied to lead 160 which is effective over lead 161 at BYTE LOAD 162.

The U6' BYTE LOAD output Q goes high, and the BACKPLANE SELECT U11 (as shown in box 107) is advanced via this output on clock lead 163.

Also, the first byte is loaded into the SEGMENT LATCH AND OUTPUT 123, shown as chips U15 and U16 under logic control over branch lead 164 (of lead 163) and via pulse forming network 135, where the front edge of the rising wavefront on lead 163 is differentiated into a sharp pulse. It passes through LEVEL SHIFT 139, shown as U12, and emerges on lead 144 for operation of U15 and U16 to load the first byte of a character from the FIFO 15 via buses 117, 125 and 121.

Also when the high speed clock on lead 119 effective at NAND gate 159 goes low, lead 160 applies this low to the SO input of both U2 and U3 of FIFO 15. This changes the DOR leads 156 to low for a short period until FIFO 15 is able to supply new data.

When the next clock pulse goes high, the second byte or bits 9 through 16 are ready to be loaded. So in the same manner, U6' BYTE LOAD toggles on the next high speed clock so that $\overline{Q}$ 170 now goes high to load the second 8 bits through control from lead 170 over downwardly extending branch lead 171, pulse former circuit 135', by way of LEVEL SHIFTER section U8 on lead A and thence via lead 142' to both U17 and U18 of SEGMENT LATCH AND OUTPUT section 127. The same pulse is effective over lead 170 to AND gate U4' to reset the flip flop U6 for the LOGIC 111.

The cycle repeats itself upon the occurrence of the next low speed clock signal on lead 105' to U6 provided that data is available and the high speed clock is applied over lead 119 to AND circuit 159 to initiate loading of the next character. And of course, each time bits one to eight, or the first byte of a character, are loaded into SEGMENT LATCH AND OUTPUT U15, U16, the BACKPLANE SELECT 107 is advanced.

In this manner, data is applied by the SEGMENT LATCH AND OUTPUT, section 123, chips U15 and U16 to the first 8 bit lines $S_a$, $S_b$, $S_c$, $S_d$, $S_e$, $S_f$, $S_g$ and $S_h$ to selectively energize the segments as coded. The second byte or 8 bits are applied to segments $S_j$, $S_k$, $S_l$, $S_m$, $S_n$, $S_p$, $S_r$ and $S_s$ over the output leads of the lower chips U17 and U18 of SEGMENT LATCH AND OUTPUT section 127.

To initiate loading of FIFO 15, AND circuit U4 (of the RCA 4081 type) receives chip select on lead 129 and strobe on lead 130. Both signals must be present to input data into the FIFO chips U2 and U3, each of the 40105 type. The control signals pass to FIFO 15 over lead 133 and branch leads 134 and 135 for the upper chip U2 and the lower chip U3, respectively. The data is inputted into FIFO 15 over the bus line 0–7 (marked 132) of which the upper four extend to the chip U2 and the lower four to chip U3.

The POLARITY flip flop is shown at 150 and its purpose is to invert the polarity on the backplanes and all segments after each backplane cycle, i.e. six backplanes have been energized to avoid plating problems. This is achieved by changing the state of the POLARITY flip flop U7 after six backplane potentials have been applied. This is effected over lead 230 from the Q output lead of BACKPLANE SELECT 107 to the C input lead of POLARITY U7. Branch lead 231 applies the same end of cycle signal pulse to reset RESET CONTROL U7' automatically at this time.

The Q output of POLARITY flip flop U7 goes high for one cycle of BACKPLANE SELECT 107 and low for the next cycle as it is toggled. The polarity inverting is achieved over Q output lead 232, branch lead 233, LEVEL SHIFT U12 and its $A_0$ output lead 234 to all levels of BACKPLANE OUTPUT AND LEVEL SHIFT 111. The path for polarity inverting to SEGMENT LATCH AND OUTPUT U15, U16, U17 and U18 levels is by way of Q output lead 232 of POLARITY U7, branch lead 234', LEVEL SHIFT U12, lead 147 and branch leads 235, 236, 237, and 238.

The five voltages used in the present system are $V_{S+}$, $V_{REF}$, $V_{S-}$, $V_{SS}$, $V_{GG}$ and in addition $V_{DD}$ is ground. Ground or $V_{DD}$ and $V_{SS}$ and $V_{GG}$ are provided from a conventional power supply. However, the relationship between the other three voltages levels is such that the voltage source 201 is provided to develop these voltages, as is best shown in FIG. 7*a*. $V_{SS}$ and $V_{GG}$ are applied at two positions in the voltage source 201 in order to develop the other voltages. The lower op amp 203 (a UA776 chip) is connected as a buffer amp to source and sync the proper amount of current and still maintain the proper voltage $V_{REF.}$. The power supply voltages $V_{SS}$ and $V_{GG}$ are applied across the two 1 megohm resistors 205 and 207 connected in series, with the junction therebetween connected over lead 209 to the positive input of op amp 203. Op amp 203 has a gain of one or unity so that its output voltage on lead 211, i.e. $V_{REF.}$ will be the same as the voltage on input lead 209. In this way, a low power device is presented because it is now not necessary to source or sync any current through either one megohm resistor 205 or 207.

$V_{REF.}$ is the center voltage of which it is desired that the two segment voltages $V_{S-}$ and $V_{S+}$ be equi-distant therefrom on either side thereof. Thus, $V_{REF.}$ is used as a reference voltage for both of the other U19 op amps 215 and 217.

These voltages should be variable because the threshold voltages for the various displays, by the same or different manufacturers, vary sufficiently that the adjustment is necessary. For this reason, a potentiometer 219 is connected between the resistors 221 and 223, respectively having their other ends connected to power supply voltages $V_{SS}$ and $V_{GG}$. Thus, adjustment of tap 225, on potentiometer 219, permits setting of the proper voltages for operation with the various liquid crystals.

This potentiometer adjustment provides control over the magnitudes of $V_{S-}$ and $V_{S+}$, which are the opposite polarities for the segment voltages. Hence, adjustment of tap 225 determines the magnitudes of the segment voltages relative to the backplane voltages $V_{SS}$ and $V_{GG}$, as well as the backplane reference voltage $V_{REF.}$.

The circuitry of voltage source 201 also offers another advantage in that it may be temperature compensated, by employing a single thermistor at a location corresponding to, for example, the resistor 221, such that the variable voltage on tap 225 for the op amps 215 and 217 is automatically temperature compensated. The resistance of the thermistor in series with the resistors is also sufficiently high so as to preclude high currents and consequent power loss in the circuit of 201. Similarly, the lower resistor 223 can be totally or partially replaced by a single thermistor, and accomplish the same purpose of changing the segment drive voltages for changes of temperature affecting the display, because the thermistor may be placed in proximity with the display.

In this manner the present invention accomplishes the multiplex driving of sixteen (or more) segment—six or more—characters from the five voltages just evolved for display, including alphanumeric.

Those skilled in the art may perceive certain modifications which can be made to the apparatus. However, any modifications which fall within the purview of this description are intended to be included therein as well. The description is intended to be illustrative only and is not intended to be limitative. Rather, the scope of the invention is defined by the claims appended hereto.

Having thus described the preferred embodiment of the invention, what is claimed is:

1. A liquid crystal device multiplex driver circuit capable of operating arrays of many characters comprised of a plurality of segments each with each character having a backplane, comprising:

means for developing first, second, and third levels of backplane voltages, characterized by:

a reference level backplane voltage;

a higher than reference level backplane voltage;

a lower than reference level backplane voltage;

means for developing high and low segment voltages respectively having levels between said reference backplane voltage and said higher than reference backplane voltage and between said reference backplane voltage and said lower than reference backplane voltage;

said higher than reference and said lower than reference voltages being alternating polarity voltages and said high and low segment voltages being alternating polarity voltages;

means electrically connecting corresponding segments of the respective characters together;

means applying the backplane voltages to the character backplanes;

means selectively applying the segment voltages to the segments whereby coincidence of application of backplane voltage of one polarity to a given backplane and segment voltage of opposite polarity to a segment of said given backplane causes energization of the liquid crystal therebetween;

means for cyclically reversing the polarities of the voltages applied to the backplanes and segments;

said means selectively applying comprising storage register means for temporarily storing data for display;

level shifter means connected to the storage register means; and segment driver means connected between the level shifter means and the segments;

said means applying the backplane voltages comprising means for shifting the voltage level of the backplane voltages;

said means selectively applying further comprising means for shifting the voltage level of the segment voltages;

said means selectively applying still further comprising a pair of 8 bit latches each having a capacity of one byte; and each character comprising two bytes whereby 16 bits may respectively control 16 segments per character to form the characters; and, said means for cyclically reversing comprising backplane select means for sequentially supplying backplane voltages for the backplanes, and cycle complete control means responsive to the backplane select means to produce a cycle complete signal after all backplanes have received backplane voltage for automatically re-initializing the backplane select means.

2. The circuit of claim 1 wherein the means for cyclically reversing, further comprises:

polarity control means for reversing the polarity of said voltages in response to said re-initialized backplane select signal.

3. The circuit of claim 2 wherein the voltage developing means, comprise:

op amp means for producing the reference level backplane voltage and the bipolar high and low segment voltages equally and oppositely related thereto; and, means for varying the levels of the high and low segment voltages while maintaining said equal and opposite relation.

4. The method of multiplex driving liquid crystal device arrays of many characters comprised of a plurality of segments each, with each character having a backplane, comprising the steps of:

developing first, second, and third levels of backplane voltages, characterized by:

a reference level backplane voltage;

a higher than reference level backplane voltage;

a lower than reference level backplane voltage;

developing high and low segment voltages respectively having levels between said reference backplane voltage and said higher than reference backplane voltage and between said reference backplane voltage and said lower than reference backplane voltage;

said higher than reference and said lower than reference voltages being alternating polarity voltages and said high and low segment voltages being alternating polarity voltages;

the difference in magnitude of the respective voltages wherein each phase being less than a threshold voltage for energizing a segment;

electrically connecting corresponding segments of the respective characters together;

applying the backplane voltages to the character backplanes;

selectively applying the segment voltages to the segments whereby coincidence of application of backplane voltage of one polarity to a given backplane and segment voltage of opposite polarity to a segment of said given backplane causes energization of the liquid crystal therebetween;

cyclically reversing the polarities of the voltages applied to the backplanes and segments;

said selectively applying comprises temporarily storing data for display in a storage register;

said applying the backplane voltages comprises shifting the voltage level of the backplane voltages; and, said selectively applying further comprises shifting the voltage level of the segment voltages;

said selectively applying still further comprises latching data determining the selective applying into a pair of 8 bit latches each having a capacity of one byte; and, each character comprising two bytes whereby 16 bits may respectively control 16 segments per character to form the characters.

5. The method of claim 4 wherein the cyclically reversing, comprises:

sequentially supply backplane voltages for the backplanes, and producing a reset signal after all backplanes have received backplane voltage for automatically re-initializing the sequential supplying.

6. The method of claim 5 wherein the cyclically reversing, further comprises:

reversing the polarity of said voltages in response to the re-initializing signal.

7. The method of claim 6 wherein the voltage developing comprises:

producing the reference level backplane voltage and the high and low segment voltages equally and oppositely related thereto; and, permitting the varying of the levels of the high and low segment voltages while maintaining said equal and opposite relation.

* * * * *

UNITED STATES PATENT AND TRADEMARK OFFICE

CERTIFICATE OF CORRECTION

PATENT NO. : 4,271,410

DATED : June 2, 1981

INVENTOR(S) : Donald G. Crawford

It is certified that error appears in the above-identified patent and that said Letters Patent are hereby corrected as shown below:

Column 1, line 28, change "in" to read -- In --.

Column 2, line 56, change "backplane" to read -- BACKPLANE --.

Column 5, line 23, change "presents" to read -- presets --.

Signed and Sealed this

*Eighth* Day of *June 1982*

[SEAL]

*Attest:*

GERALD J. MOSSINGHOFF

*Attesting Officer*

*Commissioner of Patents and Trademarks*